US012458863B2

(12) United States Patent
Khan

(10) Patent No.: US 12,458,863 B2
(45) Date of Patent: Nov. 4, 2025

(54) GOLF SWING TRACKER CARPET MAT

(71) Applicant: Mohammad Iqbal Khan, Al Ain (AE)

(72) Inventor: Mohammad Iqbal Khan, Al Ain (AE)

( * ) Notice: Subject to any disclaimer, the term of this patent is extended or adjusted under 35 U.S.C. 154(b) by 34 days.

(21) Appl. No.: 18/494,366

(22) Filed: Oct. 25, 2023

(65) Prior Publication Data

US 2025/0058195 A1 Feb. 20, 2025

Related U.S. Application Data

(60) Provisional application No. 63/520,610, filed on Aug. 19, 2023.

(51) Int. Cl.

| | |
|---|---|
| ***A63B 69/36*** | (2006.01) |
| ***D06N 7/00*** | (2006.01) |
| *A63B 71/06* | (2006.01) |

(52) U.S. Cl.

CPC ..... *A63B 69/3661* (2013.01); *D06N 7/0065* (2013.01); *D06N 7/0071* (2013.01); *A63B 2071/0694* (2013.01); *A63B 2225/76* (2020.08); *D06N 2209/083* (2013.01); *D06N 2209/0892* (2013.01); *D06N 2209/101* (2013.01); *D06N 2209/106* (2013.01); *D06N 2211/00* (2013.01)

(58) Field of Classification Search

CPC ..... A63B 69/3661; A63B 2071/0694; A63B 2225/76; D06N 7/0065; D06N 7/0071; D06N 2209/083; D06N 2209/0892; D06N 2209/101; D06N 2209/106; D06N 2211/00

USPC ..... 473/278

See application file for complete search history.

(56) References Cited

U.S. PATENT DOCUMENTS

| | | | | |
|---|---|---|---|---|
| 3,617,413 | A * | 11/1971 | Elbert | B44F 9/00 156/72 |
| 3,649,029 | A * | 3/1972 | Worrell | A63B 69/36 2/245 |
| 3,669,454 | A * | 6/1972 | Kolonel | A63B 69/3661 428/17 |
| 3,717,349 | A * | 2/1973 | Bohnen | A63B 69/3661 473/262 |
| 3,815,923 | A * | 6/1974 | Goduto | A63B 69/3661 15/207.2 |
| 4,356,220 | A * | 10/1982 | Benedyk | E01C 13/08 428/17 |
| 4,808,459 | A * | 2/1989 | Smith | D06N 7/0076 428/95 |

(Continued)

OTHER PUBLICATIONS

Amazon—Champkey Heavy-Duty Golf Hitting Mat—Swing Path Feedback Golf Practice Mat . Oct. 22, 2020 https://amzn.to/3S4Y9xT (Year: 2020).*

*Primary Examiner* — Nini F Legesse

(57) ABSTRACT

The present invention relates to a Golf Swing Tracker Carpet Mat designed for assisting golfers in improving their swing technique. The mat comprising tufted fiber yarns anchored by primary and secondary backings. When a golf club interacts with the mat, the fibers demonstrate a visual change due to a pile shading effect, simulating the appearance of a divot, and providing immediate feedback on the golfer's swing path and strike quality. The mat also features an alignment guidance pattern and is encapsulated within an anti-skid base for stability. Furthermore, the mat offers variations in tufting patterns, densities, and fiber lengths, enabling it to mimic different golf course terrains, providing a tailored practice experience for the user.

1 Claim, 12 Drawing Sheets

(56) References Cited

U.S. PATENT DOCUMENTS

| | | | | | |
|---|---|---|---|---|---|
| 4,988,106 | A * | 1/1991 | Coonrod | A63B 69/3661 | 473/162 |
| 5,104,712 | A * | 4/1992 | Walters | D06N 7/0078 | 428/317.1 |
| 5,205,562 | A * | 4/1993 | Hammon | A63B 69/3661 | 428/17 |
| 5,333,875 | A * | 8/1994 | Wilson | A63B 69/3661 | 473/262 |
| 5,655,974 | A * | 8/1997 | Bair | A63B 69/3661 | 473/262 |
| 5,885,168 | A * | 3/1999 | Bair | A63B 69/3661 | 473/262 |
| 6,060,145 | A * | 5/2000 | Smith | D06N 7/0076 | 428/95 |
| 6,106,409 | A * | 8/2000 | Jackson, Jr. | A63B 69/3661 | 473/278 |
| 6,723,413 | B2 * | 4/2004 | Walters | D06N 7/0084 | 428/95 |
| 6,866,912 | B2 * | 3/2005 | Higgins | B32B 5/26 | 428/95 |
| 2004/0079468 | A1 * | 4/2004 | Reisdorf | D06N 7/0081 | 156/72 |
| 2004/0253410 | A1 * | 12/2004 | Higgins | B32B 5/026 | 428/113 |
| 2005/0129906 | A1 * | 6/2005 | Knox | E01C 13/08 | 428/17 |
| 2006/0128493 | A1 * | 6/2006 | Snopkowski | A63B 69/3661 | 473/278 |
| 2008/0200277 | A1 * | 8/2008 | Mitchell | A63B 69/3661 | 473/270 |
| 2016/0045805 | A1 * | 2/2016 | Hooper | A63B 57/20 | 473/278 |

* cited by examiner

GOLF SWING TRACKER CARPET MAT

RELATED APPLICATION

The present application claims the benefit under 35 U.S.C. § 119 (e) of U.S. Provisional Patent Application No. 63/520,610, filed on Aug. 19, 2023, the entirety of which is incorporated herein by reference.

FIELD OF THE INVENTION

The present invention relates to golf training equipment, specifically to a golf swing tracking mat. This Golf Swing Tracker Carpet Mat is manufactured using the cut-pile carpet technique and is optimized for enhanced durability and precise swing feedback. By employing the pile shading principle of durable carpet fibers, the mat simulates a divot, offering golfers instant feedback on their swing technique and direction.

BACKGROUND OF THE INVENTION

While numerous golf training aids aimed at diagnosing and correcting golf swings exist, many face limitations in durability, lack of real grass feel, potential damage to clubs, or inadequate swing feedback. There is a need for a golf mat that delivers instant, clear feedback to golfers about their swing path and is also durable and safe for golf club use.

Traditional golf training aids, especially turf golf mats, have long presented golfers with a limited scope for effective practice. Many of these mats lack durability and fail to provide real-time, discernible feedback to the golfer. Recent advances have introduced golf tracker mats made of velvet fabric, varieties of nylon and other similar fabric, providing a plush surface. However, these also have their limitations. These mats often comprising smaller hair-like yarn glued to a thin backing or resembling typical cloth pieces either woven or knitted together. Despite their plush texture, their durability remains a concern. Other golf tracker mats, made with pivotal plastic-made disc sequins, deteriorate rapidly when subjected to the consistent force of golf swings. This has resulted in a growing need for a more resilient and efficient golf swing tracking mat that offers both durability and effective feedback.

The term "pile shading" refers to a phenomenon observed in materials with raised fibers or tufts. When the pile of such materials is oriented or brushed in a particular direction, it can reflect light differently than when oriented in an opposite or different direction. As a result, the same material can exhibit varying shades or appearances based solely on the direction of its pile. This change in visual appearance is not due to any inherent color difference in the material but rather how light interacts with the oriented fibers.

DESCRIPTION OF THE RELATED ART

The art of golf is heavily rooted in the mastery of the golf swing. For both professionals and enthusiasts, achieving the perfect golf swing represents a synthesis of technique, timing, and practice. However, mastering this swing is a challenging feat, given the myriad of variables involved, including the golfer's stance, grip, swing plane, and the point of impact between the club and the ball.

One of the primary challenges faced by golfers is receiving real-time feedback on their swing. While the end result—the trajectory and landing of the ball-offers some insight, it doesn't provide comprehensive feedback on the nuances of the swing itself. This makes it challenging for golfers to pinpoint specific areas of improvement in their technique.

To address this, various tools and devices have been developed to aid golfers in their quest for the perfect swing. Traditional methods, such as observing shadow or reflection, while practicing, have been used. However, these methods are often imprecise and don't offer the granularity of feedback that a golfer might need. More modern solutions involve electronic devices and sensors attached to the club or the golfer's body. These tools can provide detailed data, but they can be intrusive or cumbersome, potentially affecting the natural swing of the golfer.

Another realm of development has been in the design of golf mats and surfaces used for practice. The ideal golf mat should not only simulate the feel of a real golf course but also provide feedback on the swing. Traditional golf turf mats in the market, while durable and closely mimicking real grass, often fall short in providing dynamic feedback to the golfer.

A notable exception to this has been the introduction of mats that change color upon impact, giving a visual cue of the swing's path. However, these designs have limitations in terms of durability, accuracy, and reset capabilities.

Given these challenges, there is a pressing need in the art for a golf practice tool that can provide precise, real-time feedback on a golfer's swing without being intrusive, while also being durable and easy to use.

PRIOR ART

While numerous golf aids exist, aimed at diagnosing and correcting golf swings, many come with inherent drawbacks:

Traditional golf practice mats, such as the one disclosed in U.S. Pat. No. 3,451,683 by Oliver, use artificial turf instead of real grass. While this offers durability, such mats do not allow golfers to take a divot, eliminating a critical feedback mechanism for developing a proper golf swing.

Divot Indicating Mats: A newer approach is illustrated in U.S. Patent Application 2003/0087708 for the Tiffin mat. Instead of using turf-like materials, Tiffin's mat has a surface that keeps marks and shows golf ball images. Golfers place a real ball over the printed one and hit it. The club leaves a mark on the mat, mimicking a divot. By looking at this mark, golfers can see if they hit the ball correctly. However, Tiffin's mat lacks the real feel of striking a ball on actual grass, which standard golf mats offer.

Metal Strand-based Mats: In U.S. Pat. No. 3,717,349A, Bohnen introduced a unique golf practice mat designed for divot simulation, utilizing flexible metal wire strands anchored on a solid base. Golfers position a ball on these strands and swing. Upon impact, the strands flex, reflecting the golf club's direction and creating a mock divot. However, the feel is far from natural turf, and potential club damage poses a concern. Additionally, the mat offers no indication of the ball's original position.

Resettable Path Indicating Mats: To improve swing feedback, some designs have integrated colour-changing grass-mimicking blades. While innovative, there is still room for more comprehensive feedback mechanisms that give golfers a clearer picture of their swing path.

US Patent Application No. US20060128493A1 introduces designs for a golf swing device. The standout design involves a mat made from synthetic turf fibers, such as polyethylene. These fibers signify the golf club's impact in three main ways: they change color from the heat of the strike, they have two different colors on each side and flip to reveal the opposite color upon impact, and the mat emulates natural grass grain by slanting the fibers or letting them pivot on contact. Nonetheless, these designs face several issues. The color-change mechanism is temperature-sensitive and may fade during hot weather. Regular usage might reduce the design's effectiveness and a softer golf swing might not produce the anticipated color shift. Furthermore, the tight configuration of the fibers can obscure the visual representation of the "divot".

U.S. Pat. No. 7,448,956B2 discloses an artificial grass blade comprising a dual-color membrane that pivots about a central stiffener. Upon contact with a golf club, the blade changes color, emulating a natural grass divot. The structure is supported by two external pillars and a central pillar, all interconnected by a flexible membrane. These blades, primarily made from thermoplastic elastomers, can adopt distinct colors. However, the design may present challenges in durability and manufacturing.

U.S. Pat. No. 10,639,539B1 discloses a golf practice board that visually represents a golfer's swing path. The apparatus comprises a frame and a mat supporting multicolored disc sequins with different colors on their obverse and reverse surfaces. When a golf club moves across the board, the disc sequins pivot, exposing their reverse color, thereby simulating a divot pattern. To reset, users simply glide a hand across the board. However, the apparatus may have limitations, including potential wear from the disc sequins, a tactile difference from real turf, and the possibility of scratching golf club heads.

U.S. Pat. No. 8,157,667B2 discloses a golf swing training aid comprising a flexible mat and a ball support member. The support member flexes when the ball is struck, allowing the club to simulate creating a divot, offering visual cues and tactile feedback. Despite its adaptability, the device might pose challenges, especially for novices, due to its multiple components and potential setup complexities.

U.S. Pat. No. 9,561,422B1 discloses a golf training apparatus comprising a housing platform with movable ball pins to give real-time feedback on swing path and ball impact. This design aids golfers in correcting swing mistakes. However, its multiple components may seem complex for beginners, and concerns exist about durability, user adjustment to feedback, portability, and potential maintenance, especially for the ball pins.

The U.S. Pat. No. 3,815,923A patent describes a golf swing analysis mat, featuring a backing with bicolored, pliable fibers made by fusing two differently colored plastic segments. These fibers, when struck, visually indicate the path of a golf club swing. However, the design presents potential drawbacks. The plastic fibers could degrade with repeated bending, and their heat-fused nature may be susceptible to wear from friction or environmental heat. Over time, the fibers' colors might fade, diminishing their effectiveness. Manufacturing complexities could also raise the product's price compared to simpler alternatives.

The U.S. Pat. No. 8,282,502B1 describes a golf swing training mat with an artificial grass surface. The mat features a rotatable round insert within a recess, covered with a special fiber mat that visually traces a golfer's swing by altering fiber orientation upon club contact. Beneath the mat are retractable string spools which, when extended, set a desired training angle, aligning with the fiber mat's markings. Additionally, a pivotal string angle plate under the round insert aids in adjusting training angles. However, the mat's intricate design requires careful handling to prevent potential malfunctions.

The U.S. Pat. No. 11,504,596B2 patent relates to a golf training platform with a turf section. Beneath this turf lies an 'energy transfer pad', enhancing the turf's responsiveness when a golf club strikes it. This pad, crafted from open cell foam materials like polyester, polyether, or polyurethane, possesses a specific porosity under 20 PPI. The platform intricate setup might be daunting for some. The foam's longevity and its potential degradation could influence the golfer's experience over prolonged use.

U.S. Patent Application No. US20210038962A1 discloses an artificial golf turf that simulates a "virtual divot" using thermochromic-infused synthetic grass blades that change color on impact and a compressible resilient layer beneath. These features allow golfers to quickly assess swing impact. However, potential challenges include ambient temperature sensitivity, material durability concerns, limited analysis time, and issues related to the specific trans-chromic materials used.

NEED FOR THE INVENTION

Considering the limitations of existing golf training aids, there's a significant need for a golf swing tracking mat that is both durable and efficient. Such a mat should not only simulate the natural feel of a golf course but also provide valuable insights into the golfer's swing. The point of impact, also known as the "critical zone," is where the golf club contacts the ball, influencing its trajectory, speed, and spin. Feedback at this juncture is invaluable for golfers aiming to refine their technique. Therefore, the ideal golf swing tracking mat should provide detailed feedback during this critical zone, be lightweight, offer a feel similar to natural turf shots, and possess unmatched durability. The present invention aims to address these challenges, offering a comprehensive solution that effectively merges the immediate feedback advantage of the pile shading principle with an unprecedented level of durability.

SUMMARY OF THE INVENTION

The present invention introduces a Golf Swing Tracker Carpet Mat distinguished by its manufacturing methodology, specifically leveraging the cut-pile carpet technique. This technique, typically reserved for producing durable carpets, employs tufted yarns, which, when cut, produce a plush, upright pile. In the context of a golf mat, this ensures enhanced durability, while retaining the necessary texture for tracking swings and indicating divots via the pile shading principle.

KEY ASPECTS OF THE INVENTION

Manufacturing Distinction: The core invention revolves around utilizing the cut-pile carpet manufacturing technique. This technique diverges significantly from traditional golf mat-making methods, such as glued smaller yarn pieces to a thin backing or woven/knitted fabric. The carpet cut-pile process involves tufting yarns through a primary backing 3 material and then uniformly cutting them, yielding a plush and resilient surface 1 that is inherent to the structure.

Divot Indication Mechanism: Leveraging the pile shading effect, the Golf Swing Tracker Carpet Mat's uniformly oriented fibers 2 change their reflective angles upon impact with a golf club 12, simulating a divot. The mat employs an optimized cut-pile height and specific fibers to accentuate this effect. This unique pile reversal shading, innate to cut-pile carpet structures, provides superior visual feedback compared to mats made from glued fabric pieces or traditional cloth, ensuring consistent and enhanced feedback upon golf instrument impact.

Unlike the color-changing feature in the prior art, which may degrade with usage, our Golf Swing Tracker Carpet Mat harnesses carpet-fiber 2 pile shading for visual feedback. This method doesn't depend on the golfer's swing force or external factors, unlike color-based mechanisms, guaranteeing each golfer receives precise feedback irrespective of swing intensity.

Material and Composition: The mat's surface 1 can be made of various fibers 2, including nylon, polyester, wool, and the likes thereof. These materials have been selected for their resilience compared to conventional golf mats, with potential for UV resistance, moisture repelling, and tactile feedback enhancement.

Durability Features: The tufting mechanism securely anchors fibers 2 to the primary backing 3, providing superior durability. Different tufting patterns and densities can be used to mimic various golf course terrains. Our Golf Swing Tracker Carpet Mat, thanks to its construction based on the cut-pile carpet technique, surpasses its existing golf tracker mats in terms of durability and longevity, steering clear from the wear and adhesive failures seen in woven or knitted mats. It stands as a significant advancement in the realm of golf mats, addressing the prevalent issue of mats wearing out quickly due to intense golf swings. This invention deftly combines the immediate feedback advantage of the pile shading principle with unmatched durability.

Precision Manufacturing: Our golf tracker mat benefits from specialized machinery tailored specifically for cut-pile carpet manufacturing. This ensures precision in tuft density, configuration, and cutting, leading to a product that consistently meets the desired specifications.

Sustainable Production: By employing the cut-pile technique, the necessity for adhesives, commonly used in gluing fabric pieces, is effectively eliminated. This not only heightens the product's longevity but also presents a more environmentally friendly manufacturing process.

Feedback Mechanism: The color contrast created by the pile shading effect serves as instant feedback for the golfer regarding their swing path and quality of ball strike.

Alignment Guidance 7: The mat comprises a distinct alignment pattern using fibers 2 of contrasting colors to assist with ball 11 centering and post-strike analysis. Additionally, innovative features like glow-in-the-dark fibers can be incorporated for low-light conditions.

Design Variations: Various finishes can be availed, and by altering the twist 100 in the fiber 2 yarn, durability can be further maximized.

Backings and Stability: Multiple backings are introduced, including a primary synthetic backing to anchor fibers 2 and secondary backings 4 like jute, latex, and PVC for added stability and shock absorbency. Modular backings can also be introduced for adaptability to different terrains.

Sturdy Base 6: An anti-skid base 6 envelops the mat, ensuring its stability during use. This base 6 allows for interchangeable mats, portability features, and adjustable footings for uneven terrains.

Bonding Techniques: Various bonding agents can be used, such as latex adhesive to thermosetting resins, are employed to enhance the mat's durability.

DETAILED DESCRIPTION OF THE INVENTION

Our Golf Swing Tracker Carpet Mat is a groundbreaking innovation designed to revolutionize the golf practice experience. Unlike traditional golf mats, this mat employs the cut-pile carpet manufacturing technique, tufting yarns through a primary backing 3 followed by uniform shearing to create a plush, consistent surface 1. This method, distinct from existing golf tracker mats that use glued or woven fabrics, offers superior durability by eliminating adhesives and capitalizing on the inherent strength of tufted 15 yarns. Additionally, the mat's unique divot indication mechanism leverages the pile shading effect of carpet fibers 2, providing golfers with immediate, discernible feedback on their swing's direction and force. With the added benefits of specialized machinery ensuring precision, environmental advantages by reducing reliance on harmful chemicals, and seamless integration with existing golf training technologies, the Golf Swing Tracker Carpet Mat stands as a versatile and efficient tool for golf analytics and training.

Divot Indication Mechanism: Pile Shading Principle

The innovation behind our golf tracker mat goes beyond just the use of the cut-pile carpet technique. An inherent advantage of this method materializes in the form of the pile shading principle, which forms the crux of our divot indication mechanism. Here's how it operates:

Understanding Pile Shading: Pile shading is observed in cut-pile carpets where tufts of yarn can change direction under applied pressure. This change in direction causes light to reflect differently, thus giving an appearance of a "shade" or "mark." In the context of our golf tracker mat, this shading phenomenon serves as an immediate feedback mechanism.

Direct Feedback through Swing Impact: As a golfer takes a swing and the club makes contact with the mat, the yarn tufts in the impacted area change direction. This change is instantaneously visible, giving the golfer an immediate understanding of their swing's contact point and quality. To enhance this visual contrast, the golf mat uses an optimized cut-pile design. The mat employs softer polyester fibers, which are responsive to direction changes and provide pronounced shading. This feedback mechanism, combined with the cut-pile technique, offers golfers immediate and clear insights about the quality and direction of their strike.

Enhancement through Cut-Pile Technique: Traditional methods might offer similar shading effects, but the uniform shearing and tufting inherent in the cut-pile technique make these indications clearer and more consistent. The tufted 15 yarns of the mat, being densely packed and uniformly sheared, provide a more pronounced and consistent shading effect than methods reliant on glued or woven fabrics.

Durability of the Divot Indication Mechanism: The pile reversal shading effect is not a one-time feature. Thanks to the resilience of the cut-pile structure, the mat can endure countless swings, always bouncing back to its original state while continuing to provide accurate feedback. Over time, while a glued or woven fabric might degrade or lose its feedback quality, the cut-pile technique ensures longevity of this feature. Users can easily restore the mat's appearance with a simple brush, readying it for subsequent practice sessions.

Training Advantages: For golfers, this immediate feedback is invaluable. It allows them to adjust their techniques on-the-fly, understand patterns in their swings, and ultimately hone their skills with precision.

In essence, the Divot Indication Mechanism of our Golf Swing Tracker Carpet Mat, when combined with the cut-pile carpet technique, creates a synergy that provides golfers with an unmatched, durable, and efficient feedback system.

Thus, this mat stands as both a testament to innovative manufacturing and as a tool to enhance the golfer's training experience.

Key Features and Industrial Manufacturing Process

Mat Surface 1 Fiber 2 Composition: The principal surface 1 fiber 2 of the mat can be composed of various materials, including but not limited to nylon, polyester, wool, and equivalents thereof. This invention, made from these fibers 2, presents superior resilience when compared to existing mats fabricated from plastic strands or pivotal plastic sequins discs. Additionally, the fibers 2 can be mixed in combinations or treated with coatings for UV resistance, moisture repelling, or for enhancing tactile feedback.

Tufting Mechanism for Durability: For heightened durability, the surface 1 mat fiber 2 is looped through the primary backing 3. Following this, the loops are sheared, giving rise to the "upward cut-pile" appearance. Each fiber 2, tufted 15 securely to the backing, stands upright, distinct from its neighboring fibers 2. The tufting pattern can vary, including but not limited to, diagonal, zigzag, or radial patterns, each influencing the feedback and resilience differently.

Varied Tufting Densities and Imitation of Golf Course: An embodiment of the mat can feature various tufting densities and fiber 2 lengths to simulate different grass lengths typically found on golf courses-including the Tee, Fairway, Foregreen, Semi-rough, and Green.

Visual Feedback Mechanism: Striking against the fiber's 2 orientation results in a noticeable color contrast, simulating a virtual divot. This offers the golfer instantaneous feedback regarding their swing direction and ball-strike quality. This color contrast remains visible until manually reset by the user, enabling the golfer to review and understand the golf club's 12 swing path. Resetting is facilitated by merely brushing with the golf club's 12 head, prepping the mat for subsequent usage.

Alignment Guidance 7 Pattern: The mat incorporates a distinct alignment guidance 7 pattern utilizing fibers 2 of contrasting colors. This aids in golf ball 11 centering and direction analysis post-strike. While the primary color for the mat surface 1 mimics natural green grass, alternative colors can be chosen to offer enhanced visual contrast. Beyond contrasting colors, the mat could incorporate luminous or glow-in-the-dark fibers for improved visibility in low-light conditions Finishes and Durability Enhancements: The mat can be availed in diverse finishes, from plush to textured. By varying the twist 100 in the fiber 2 yarn, the mat's durability can be further optimized.

Backing Layers: The primary backing 3, generally of synthetic origin, firmly anchors the fibers 2. After tufting, these fibers 2 undergo shearing for a uniform surface 1. A secondary backing 4 augments the mat's stability, made from materials like Polypropylene, Jute, latex, Urethane, PVC, or their equivalents. This backing can also incorporate an Integrated Cushion Backing to augment shock absorbency, minimizing injury risks. Alternative embodiments might include modular backings that can be adjusted for different terrains or surfaces 1, ensuring stability.

Sturdy Base 6: To ensure consistent placement during usage, the mat is enveloped within an anti-skid base 6 constructed from materials such as rubber, plastic, wood, or their equivalents. The sturdy base 6 will provide provision for interchangeable mats, each representing different terrains, allowing the golfer to customize their practice surface 1 or catering to wear patterns. The anti-skid rubber base 6 design can be modified to include foldable or detachable segments for portability. Alternative embodiments might include an anti-skid rubber base 6 with a handle feature for easy portability. Additionally, the rubber base 6 might feature adjustable footings for uneven terrains.

Adhesive Bonding: Latex adhesive is meticulously applied to affix the yarns to the primary backing 3 and to fuse the primary and secondary backing 4 layers. Alternative bonding agents could be explored, such as thermosetting resins, pressure-sensitive adhesives, or mechanical bonding techniques for enhanced durability.

The art of golf swing analysis has continuously aimed to provide players with immediate swing feedback. The choice of robust materials ensures resilience against golf club 12 force.

The use of carpet pile shade effect application within the realm of golf swing analysis presents a novel utilization. One might liken this to the discovery of penicillin from mold—while mold itself was well-known, its application in medicine was groundbreaking.

Moreover, the long-felt need in the industry for a durable and a cost-effective, home-friendly, and detailed swing analysis tool, made of cut-pile carpets, remained unaddressed until the advent of this invention.

As described above, the principle of carpet fiber 2 pile shading and its application to golf training mats presents a distinct novel advancement in the field. The utility of this principle within the context of golf is two-fold:

Swing Indication: The reversal shading effect offers immediate and discernible feedback to the golfer regarding their swing path, allowing them to correct and improve their technique in real-time.

Durability: The pervasive issue with existing mats is their lack of resistance to wear and tear from golf club 12 swings, with many mats tearing after just a few uses. This presents a long-felt but unresolved need in the field. Our invention directly addresses this need by offering a mat that not only provides sought-after shading feedback but is also constructed with materials durable enough to withstand repetitive golf swings.

DETAILED DESCRIPTION OF THE DRAWINGS

Figure 1:
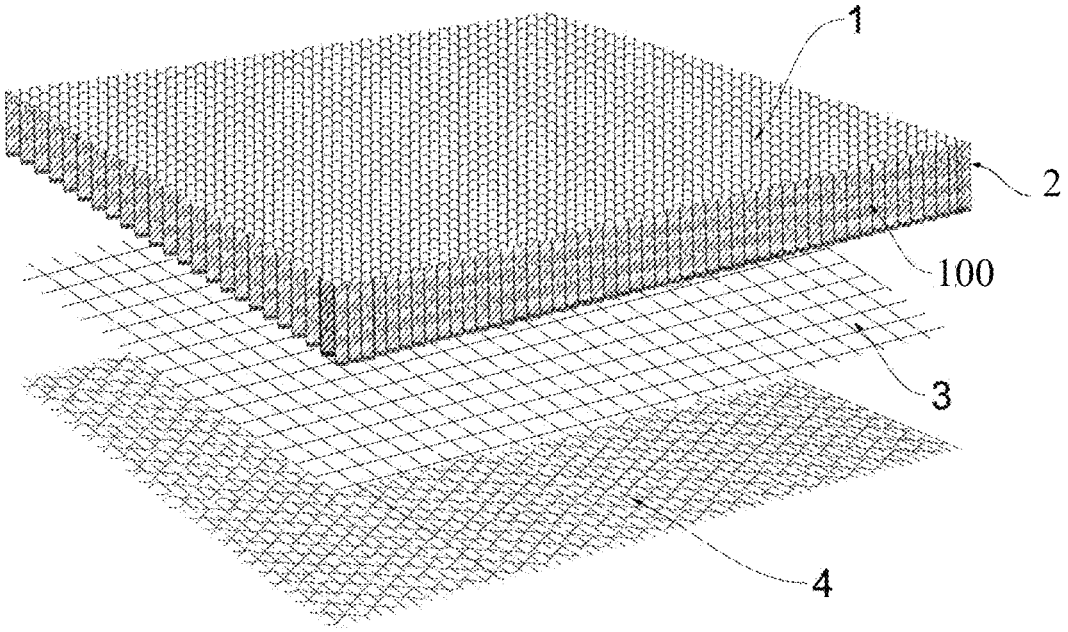
FIG. 1: A sectional perspective of the Golf Swing Tracker Carpet Mat, illustrating the tufted 15 fiber 2 yarns, the primary synthetic anchoring layer 3, and secondary-backing layers 4 including materials such as jute, latex, and PVC.

FIG. 1: This sectional view provides insight into the Golf Swing Tracker Carpet Mat's elaborate design. Starting from the tufted 15 fiber 2 yarns that face upwards, it delves deeper to reveal the primary synthetic anchoring layer followed by a secondary-backing layer like jute, latex, and PVC for added stability and shock absorbency. The primary synthetic anchoring layer is shown to have a structured arrangement of vertical and horizontal threads interlaced to form a grid-like pattern, with vertical threads parallel to each other and horizontal threads perpendicular to the vertical threads, thus providing a stable and consistent tufting base.

Figures 2A, 2B:
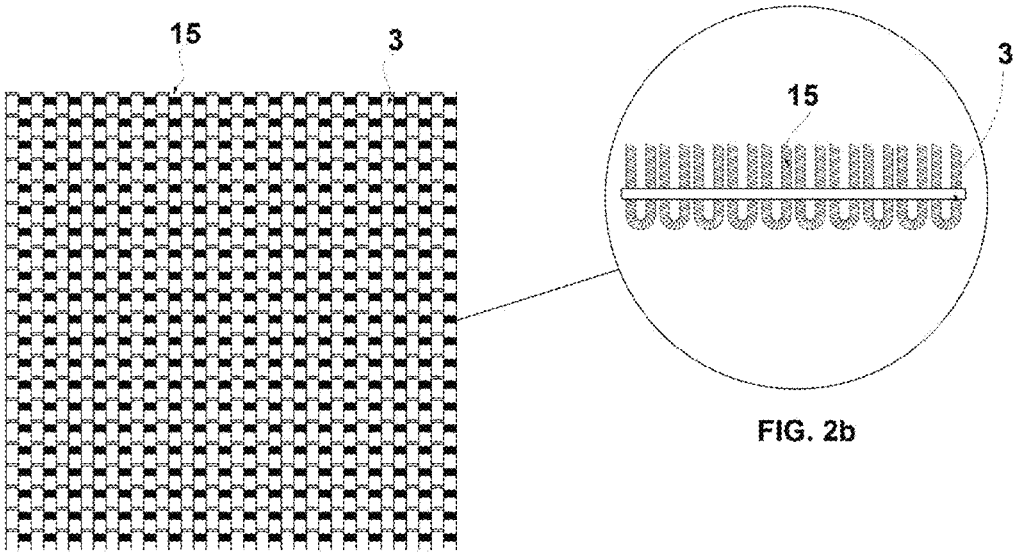
FIG. 2*a* and FIG. 2*b*: A depiction of the Golf Swing Tracker Carpet Mat showing its tufted 15 carpet fiber-yarn 2 construction, including the U-Shaped pile formed by trimmed tufted 15 loops.

FIG. 2: It provides a perspective of the Golf Swing Tracker Carpet Mat, showcasing its tufted 15 carpet fiber-yarn 2 construction. Yarn spools feed into a tufting machine equipped with hundreds of needles, which insert the yarn into a foundational backing material. These tufted 15 loops are subsequently trimmed, forming the characteristic U-Shaped pile. The widespread use of these U-Shaped fibers 2 leads to a uniformly smooth carpet surface 1.

Figure 3:
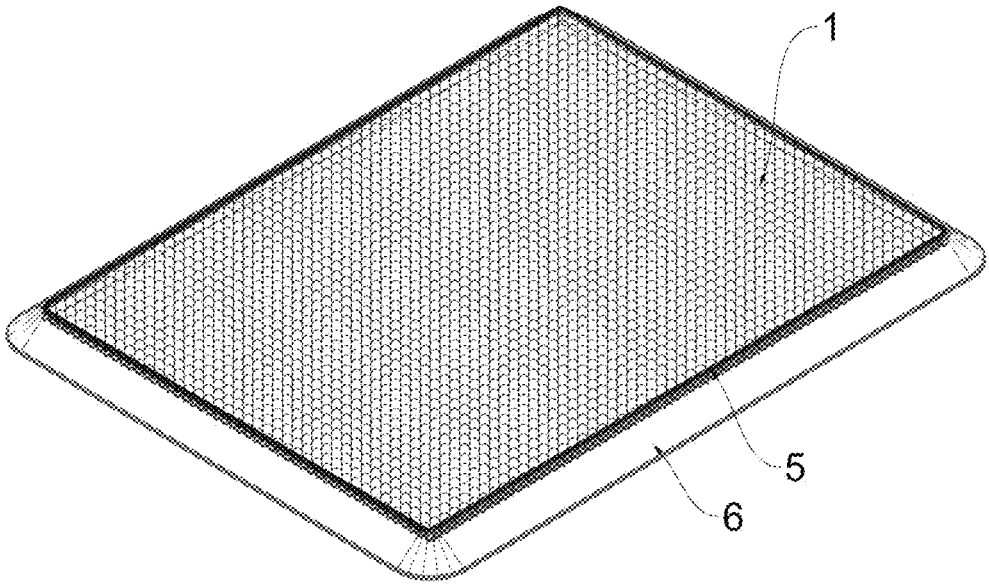
FIG. 3: A bird's-eye view of the Golf Swing Tracker Carpet Mat, emphasizing the uniformly oriented mat surface 1 fibers 2, with edges overlocking 5, encapsulated within an anti-skid rubber base 6.

FIG. 3: This bird's-eye view draws attention to the consistently oriented fibers 2 of the mat. The top surface 1 mat edges finishing involves overlocking 5 to prevent the edges of the mat from fraying and unraveling. Various edge overlocking 5 methods may be employed, for example, tightly sewing or binding the fibers 2 on the edges of the mat using a sturdy yarn. The mat edge overlocking 5 also adds neat appearance and enhanced durability and extends its lifespan. The mat is encapsulated by a sturdy rubber base 6 designed to prevent slippage during use.

Figure 4:
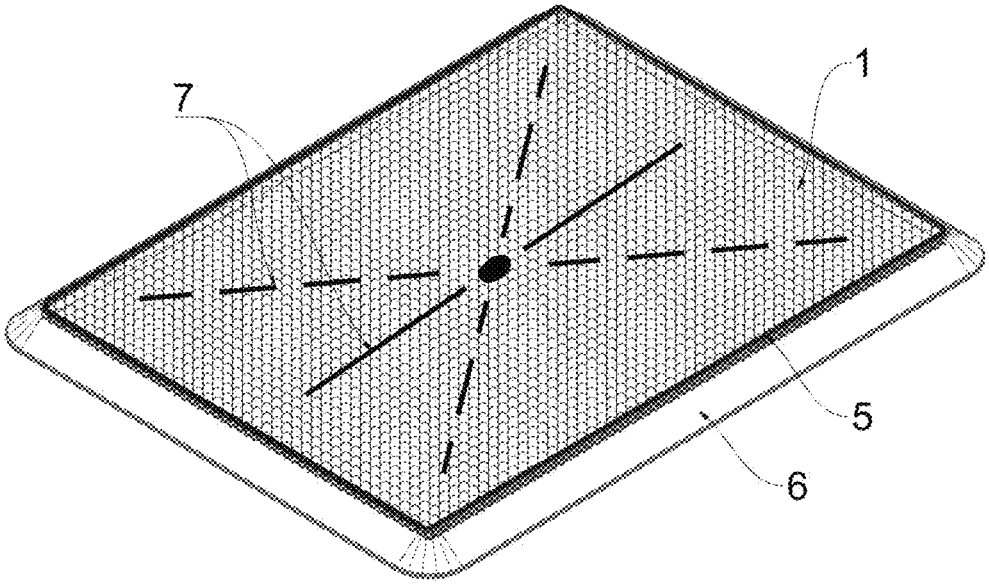
FIG. 4: A top-down view, showcasing the primary alignment guidance 7 pattern created using contrasting fiber 2 yarn colors for golf ball 11 centering and post-strike analysis 13.

FIG. 4: It is a top-down view, emphasizing the overall design and the primary alignment guidance 7 pattern. This pattern, crafted for aiding golf ball 11 centering and post-strike analysis, is distinguished by contrasting fiber 2 colors. Notably, the guidance 7 lines are not printed but are formed using differently colored fiber 2 yarns. This figure introduces the foundational alignment 7 scheme, with detailed variations presented in following illustrations.

Figure 5:
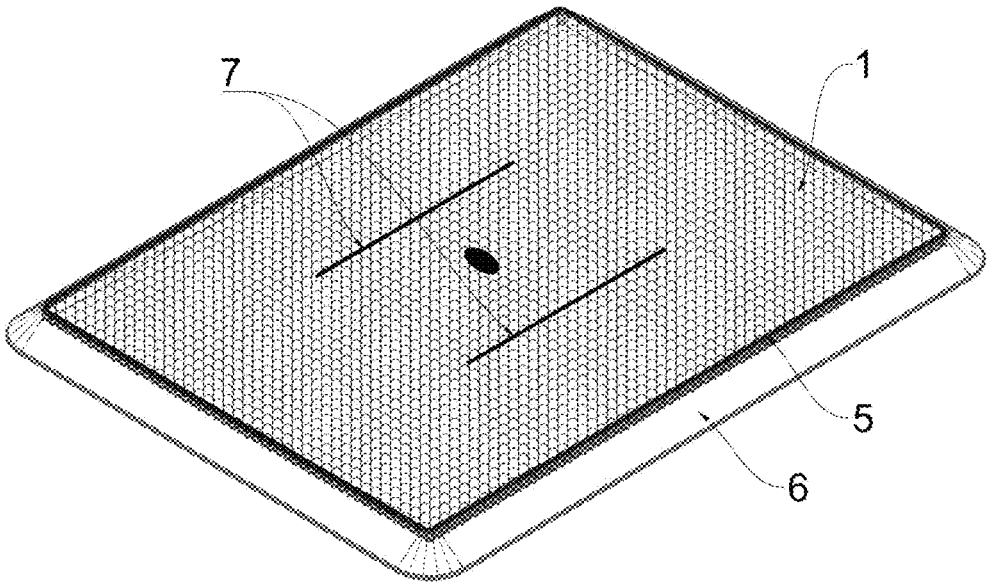
FIG. 5: A specialized depiction emphasizing the alignment guidance 7 with parallel vertical lines paired with a central circle.

FIG. 5: A particular embodiment of the alignment 7 system established in FIG. 4. Here, parallel vertical lines join a central circle.

Figure 6:
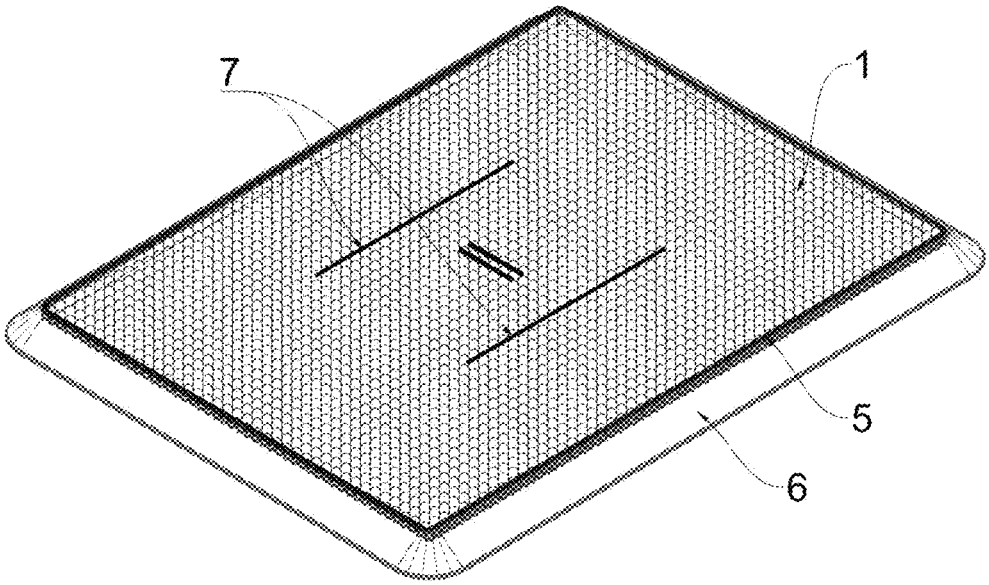
FIG. 6: An embodiment with vertical alignment 7 lines accompanied by two central horizontal markers, ideal for precise golf ball 11 placement.

FIG. 6: A variation of FIG. 4's alignment 7 pattern, emphasizing vertical alignment 7 indicators paired with two central horizontal markers, guiding golf ball 11 placement.

Figure 7:
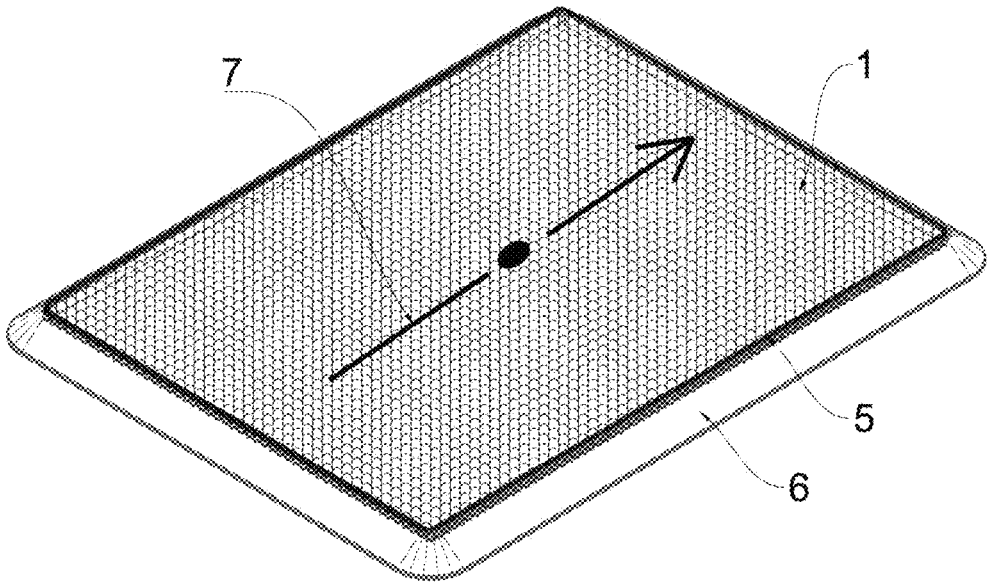
FIG. 7: A variation featuring a central alignment 7 arrow surrounded by a circle to aid in golf ball 11 positioning.

FIG. 7: This embodiment leans on the foundational design of FIG. 4, merging the central alignment 7 arrow with an encompassing circle to facilitate golf ball 11 placement.

Figure 8:
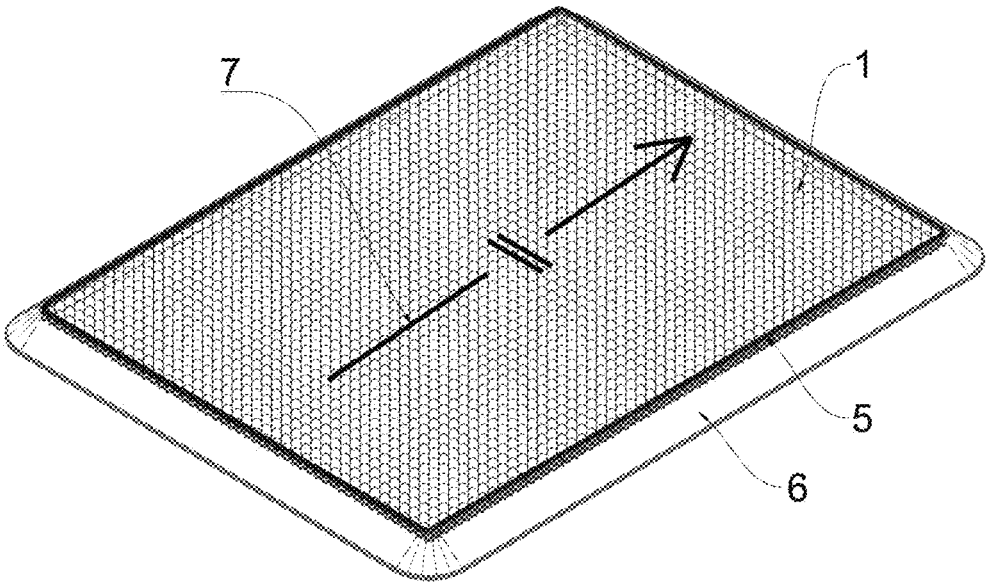
FIG. 8: Another version of the mat, presenting the central arrow along with dual horizontal markers for comprehensive swing analysis.

FIG. 8: Another adaptation of FIG. 4, underscoring the presence of the central arrow in conjunction with the twin horizontal markers for a more detailed swing analysis.

Figure 9:
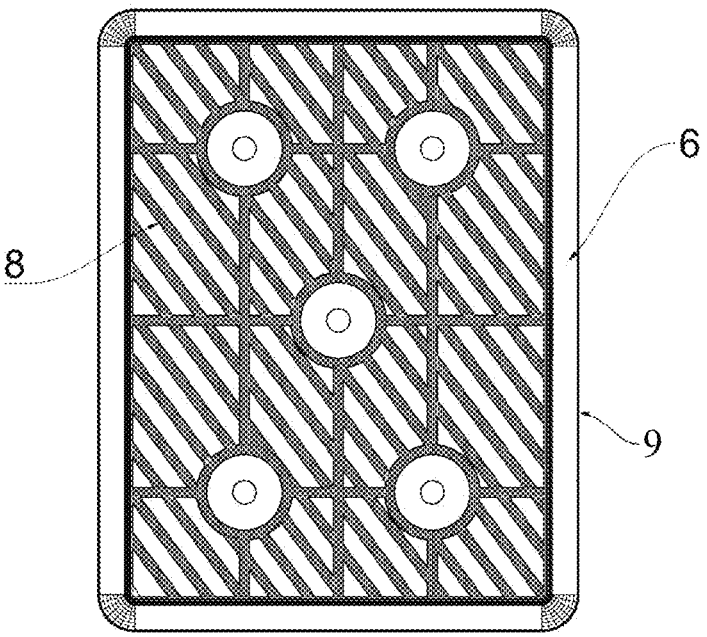
FIG. 9: A view of the sturdy rubber base 6 underside, highlighting the anti-skid design 9 complemented by weight-supporting pillars 8 for stability.

FIG. 9: Unveils the details of the underneath slip-resistant design 9 of the sturdy rubber base 6, bolstered by diagonal lines of weight-supporting pillars 8. These pillars 8 are systematically distributed, maintaining optimal spacing to ensure even weight distribution across the entire underside of the sturdy rubber base. The combination of the anti-skid design 9 of the rubber base and these weight-supporting pillars 8 plays a pivotal role in ensuring the stability of the golf mat. With this design in place, the golf mat is engineered to remain steadfast and immobile, providing users with a reliable and consistent surface 1 for play.

Figure 10:
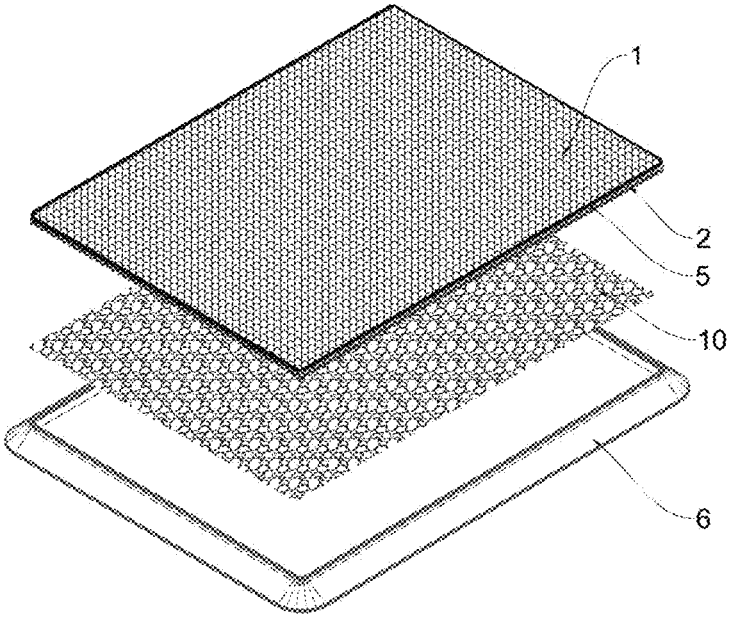
FIG. 10: A sectional illustration of the Golf Swing Tracker Carpet Mat, revealing its three-layered structure: plush carpet surface 1, cushioning foam 10, and a sturdy outer rubber base 6.

FIG. 10: Delving into the mat's structure, this cross-section unravels its tri-layered composition: a plush carpeted surface 1, an intermediate shock-absorbent foam 10 layer, and a durable external rubber base 6.

Figure 11:
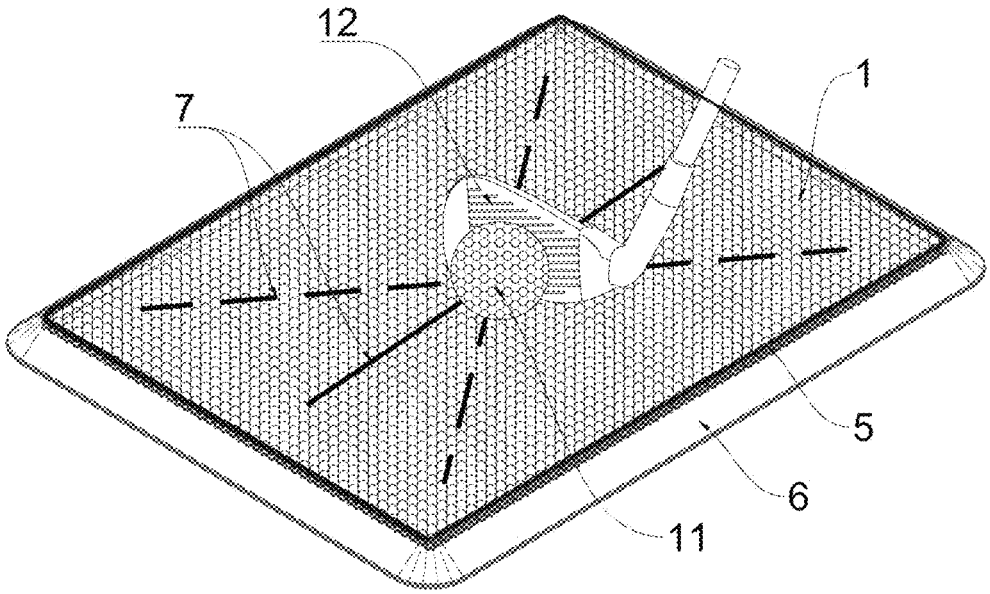
FIG. 11: A dynamic 3D perspective, portraying a poised golf ball 11, perfectly centered atop the mat's unique texture.

FIG. 11: Capturing the mat in action, this dynamic perspective offers a golf ball 11 at the ready, perfectly centred and set against the mat's textured surface 1.

Figures 12A, 12B:
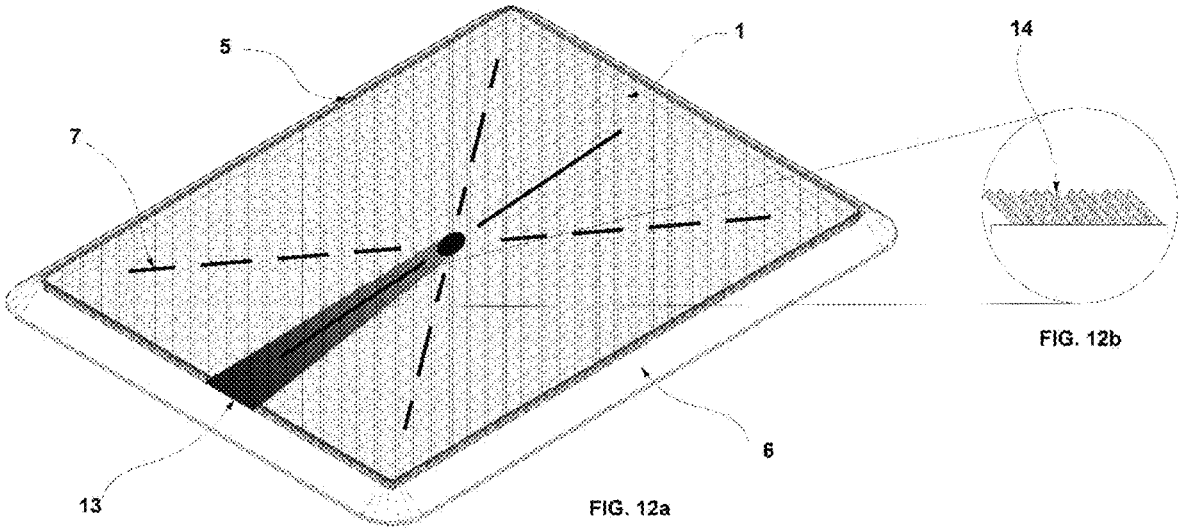
FIG. 12*a* and FIG. 12*b*: A detailed close-up, focusing on the pile shading mechanism where fibers 2 alter reflectivity upon golf club 12 contact, simulating the divot effect and giving visual feedback.

FIG. 12: This close-up perspective underscores the mat's pile shading phenomenon 14. Here, fibers 2 change their reflective properties upon impact with a golf club 12, visually mimicking the divot effect and providing feedback 13.

Utility and Advantages of the Golf Swing Tracker Carpet Mat

The Golf Swing Tracker Carpet Mat, as described in the detailed patent application, showcases an innovative design combined with practical functionalities tailored for golf enthusiasts. The core utility and numerous advantages are:

Enhanced Feedback 13 Mechanism: The most distinguishable utility of this mat is its ability to provide real-time visual feedback 13 to golfers. The pile shading effect, which changes the appearance of the mat upon impact with the club 12, serves as an instant feedback 13 mechanism. This allows golfers to understand their swing dynamics better and make immediate corrections.

Versatility: With various tufting patterns and densities, the mat can simulate different golf course terrains. Whether it's the plush greens of Augusta or the rugged terrains of a local golf course, golfers can tailor their practice sessions for specific challenges.

Durability: Built with primary and secondary backings 4 and tufted 15 fiber 2 yarns, the mat is designed to endure repetitive golf swings without deteriorating rapidly. This ensures longevity and offers golfers value for their investment.

Safety and Stability: The inclusion of an anti-skid rubber base 6 ensures that the mat remains stationary during use. This feature not only promotes safety but also guarantees that the golfer's practice session remains uninterrupted by any external shifts.

Adaptability: The adjustable footings on the anti-skid rubber base 6 adapt well to uneven terrains, ensuring that golfers can set up their practice session almost anywhere without the worry of an unstable base.

Material Versatility: The Golf Swing Tracker Carpet Mat's construction from various materials like nylon, polyester, and the likes thereof provides not just durability but also flexibility in texture and feel, mimicking real golf courses closely.

Glow-in-the-Dark Fibers: This unique feature enhances the mat's visibility in low-light conditions, enabling golfers to practice even during dusk or dawn.

User-Friendly Maintenance: Post-practice, any changes to the mat due to pile reversal can be quickly reset, ensuring the mat remains in optimal condition for the next session.

Environmental Resilience: The materials used in the mat's construction, ranging from the fibers 2 to the backings, are designed to withstand varied environmental conditions. Whether it's the humidity of a coastal region or the dryness of a desert landscape, the mat remains effective and durable.

Cost-Effective Production: Despite its advanced design, the mat can be produced cost-effectively on an industrial scale, thanks to the mature cut-pile carpet manufacturing ecosystem.

In essence, the Golf Swing Tracker Carpet Mat combines innovative design, practicality, and technology. This synergy ensures that golfers, whether novices or professionals, get the most out of their practice sessions, making the journey of mastering the perfect swing a touch easier and much more informed.

The invention claimed is:

1. A Golf Swing Tracker Carpet Mat, comprising:

(a) a primary synthetic anchoring layer having a woven backing assembly that includes:

(i) a plurality of vertical carpet backing tufting threads extending lengthwise to define a longitudinal direction;

(ii) a plurality of horizontal carpet backing tufting threads extending widthwise in a transverse direction, each of said horizontal threads interlacing with said vertical threads in an over-under arrangement to form a cohesive backing structure;

wherein the woven backing assembly is configured to provide a mechanically stable tufting base that secures rows of pile tufts in place;

wherein the horizontal threads include at least one type of yarn selected from the group consisting of jute, synthetic fibers, or blends thereof, providing said woven backing assembly with strength and dimensional stability;

wherein the primary synthetic anchoring layer is formed from one or more materials selected from the group consisting of jute, latex, polypropylene, polyester, and combinations thereof;

wherein the anchoring layer is not created by thermoset rubber cross-linking or heat-fused rubber or plastic;

(b) a plurality of durable carpet pile tufts formed from polyester carpet yarn and disposed through said woven backing assembly such that each pile tuft is integrally secured within said woven backing layer, wherein each pile tuft is oriented in a generally U-shaped configuration with uniformly cut tips directed upward to form a cut-pile surface, wherein:

said pile tufts are comprised of face yarns selected from the group consisting of wool, polyester, or blends thereof;

each pile tuft has a cut-pile height and density configured to provide visible pile shading upon golf club impact;

the durable carpet fibers simulate a divot-like appearance through pile shading upon impact by a golf club, wherein the pile shading occurs due to changes in the reflective angles of the durable carpet fibers, effectively providing visual feedback on the dynamics of the golf swing, including the contact point, quality, and direction of the swing;

the fibers are individually tufted rather than grouped into discrete fiber plugs so that each fiber is separately anchored in the woven backing assembly;

the cut-pile surface is not formed by gluing short microfibers or velvet filaments onto a thin backing; and wherein the pile tufts are mechanically interlocked between the horizontal and vertical threads and further secured by a latex adhesive applied to at least the underside of said woven backing assembly, thereby enhancing the mat's overall durability and structural integrity;

(c) a secondary backing layer bonded to said primary anchoring layer using a latex adhesive, wherein:

the secondary backing is configured to provide shock absorption and dimensional stability via said adhesive bonding;

the secondary backing is constructed from one or more materials selected from the group consisting of jute, latex, polypropylene, polyester, urethane foam, and combinations thereof; and the secondary backing is structurally distinct from crumb-rubber shock pads formed at high temperature or pressure;

(d) a carpet surface defined by the exposed ends of said pile tufts, said pile tufts forming an upright cut-pile according to a predetermined layout that produces an overall visible pattern or design, wherein:

alignment guidance patterns are integrated by tufting differently-colored durable carpet fibers directly into said cut-pile surface; and these differently-colored fibers are embedded in the woven/tufted structure to form durable, high-visibility reference lines that facilitate club positioning and swing-path analysis without relying on surface-printed or superficial markings;

(e) wherein the Golf Swing Tracker Carpet Mat is exclusively constructed using a textile-based cut-pile carpet technique employing mechanical tufting and latex adhesive bonding, without encapsulating fibers in thermoset rubber or chemically cross-linking the tuft anchoring layer, such that the resulting mat provides resilient, rapid-reset feedback via pile shading, is dimensionally stable under repeated golf swings, and is structurally distinguishable from crumb-rubber fusion or glued-velvet mats disclosed in the prior art.

* * * * *